US005271806A

United States Patent [19]

Deutsch et al.

[11] Patent Number: 5,271,806

[45] Date of Patent: Dec. 21, 1993

[54] METHOD FOR SIZING PAPER

[75] Inventors: Robert F. Deutsch, Oak Park Heights; John W. Eberlin, Stillwater; Robert F. Kamrath, Woodbury, all of Wash.

[73] Assignee: Minnesota Mining and Manufacturing Company, St. Paul, Minn.

[21] Appl. No.: 967,969

[22] Filed: Oct. 28, 1992

Related U.S. Application Data

[63] Continuation of Ser. No. 686,691, Apr. 17, 1991, abandoned.

[51] Int. Cl.[5] ..... D21H 17/10

[52] U.S. Cl. ..... 162/135; 162/158; 427/395

[58] Field of Search ..... 162/135, 158; 427/394, 427/395; 106/287.28

[56] References Cited

U.S. PATENT DOCUMENTS 3,083,224 3/1963 Brace ..... 260/461
3,094,547 6/1963 Heine ..... 260/461

FOREIGN PATENT DOCUMENTS 0280115 8/1988 European Pat. Off. .

OTHER PUBLICATIONS

Rengel and Young, "Internal Sizing of Paper and Paperboard," Tappi monograph series No. 33, pp. 170–189 (1971).

Colbert "Fluorochemicals–Fluid Repellency for Non--Woven Substrates," Tappi, The Journal of the Technical Association of the Pulp and Paper Industry, 59, 9 (Sep. 1976).

Banks, Ed., Organofluorine Chemicals and their Industrial Application, pp. 231–234 Schwartz, "Oil Resistance Utilizing Fluorochemicals" Tappi conference prepring, 1980 Sizing Short Course, Atlanta, Ga.

*Primary Examiner*—Peter Chin

*Attorney, Agent, or Firm*—Gary L. Griswold; Walter N. Kirn; Carole Ruesdale

[57] ABSTRACT

A method for sizing paper to improve resistance to wetting by liquids under hard water conditions is provided. The method comprises (a) contacting paper sheet material with a hydrocarbon surfactant free, substantially organic solvent free aqueous solution of an N-alkyl fluoroaliphaticsulfonamidoalkyl phosphate salt in hard water, said phosphate salt forming substantially no precipitate and (b) drying said sheet material or (a) adding to a paper pulp slurry in hard water, a hydrocarbon surfactant free, substantially organic solvent free aqueous solution of an N-alkyl fluoroaliphaticsulfonamidoalkyl phosphate salt, said phosphate salt forming substantially no precipitate, (b) forming said slurry into paper and (c) drying said paper.

10 Claims, No Drawings

METHOD FOR SIZING PAPER

This is a continuation of application Ser. No. 07/686,691 filed Apr. 17, 1991, abandoned.

This invention relates to methods for providing paper and paperboard with resistance to wetting by liquids using fluorochemical phosphate salts.

Various fluorochemical wet pick-up and internal sizing agents for paper treatment are described, for example, in Rengel and Young, "Internal Sizing of Paper and Paperboard," Tappi monograph series no. 33, pp. 170–189 (1971), Colbert "Fluorochemicals-Fluid Repellency for Non-woven Substrates," *Tappi, The Journal of the Technical Association of the Pulp and Paper Industry,* 59, 9 (September 1976), Banks, Ed., *Organofluorine Chemicals and their Industrial Application,* pp. 231–234 (1979) and Schwartz, "Oil Resistance Utilizing Fluorochemicals," Tappi conference preprint, 1980 Sizing Short Course, Atlanta, Ga.

U.S. Pat. No. 3,094,547 (Heine) and U.S. Pat. No. 3,083,224 (Brace) disclose fluorochemical phosphate salts useful for the sizing of fabrics to impart both repellency to water and resistance to absorption, and soiling by oily and greasy materials and to the coating and impregnation of matrices such as paper and leather. Fluorochemical phosphate salts are prepared in the presence of a solvent such as benzene, toluene, xylene, benzotrifluoride, etc. by the reaction of a fluorochemical alcohol with phosphorus oxychloride.

Several such fluorochemical phosphate salts are regulated by the U.S. Food and Drug Administration to provide for safe use on paperboard in direct contact with food for human consumption. These fluorochemical phosphate salts can be used as wet pick-up, i.e., applied to the surface of the paper such as by dipping or spraying an aqueous solution or dispersion of the fluorochemical phosphate salt, or as internal treatments, i.e., fluorochemical phosphate salt added to the aqueous pulp slurry prior to sheet formation or in a size press, i.e., dry paper passed through a flooded nip and a solution or dispersion of the fluorochemical phosphate salt contacts both sides of the paper. They primarily provide oil resistance and are used, for example, on paper plates, bags for bakery goods and snack foods, cartons and trays for fast foods, and in bags and cartons for pet foods.

The fluorochemical phosphate salts provided as aqueous/organic solvent solutions which provide good oil repellency as measured by the "Kit Test" precipitate from the solution or slurry when the water used to prepare the solution or slurry is hard. This can be overcome by adding a chelating agent to the solution or slurry prior to the addition of the fluorochemical phosphate salt. However, if the chelating agent is inadvertently omitted or added in insufficient amount prior to addition of the fluorochemical phosphate salt, the precipitate forms and inferior product is produced or production must be stopped until the precipitate is cleared.

European Patent Publication No. 0 280 115 (Daikin) discloses that addition of an anionic surfactant to the fluorochemical phosphate salt can also provide an oil resistant composition for paper which is not precipitated in hard water and can impart good oil resistance to paper. However, addition of surfactant to the fluorochemical phosphate salt can have an adverse effect on crease performance, i.e., oil penetration at a crease, and foaming problems, such as foam build-up in the treating bath, can occur.

This invention relates to a method for sizing paper to improve resistance to wetting by liquids under hard water conditions comprising (a) contacting paper sheet material with a hydrocarbon surfactant free, substantially organic solvent free aqueous solution of an N-alkyl fluoroaliphaticsulfonamidoalkyl phosphate salt in hard water, said phosphate salt forming substantially no precipitate and (b) drying said sheet material.

This invention further relates to a method for sizing paper to improve resistance to wetting by liquids under hard water conditions comprising (a) adding to a paper pulp slurry in hard water, a hydrocarbon surfactant free, substantially organic solvent free aqueous solution of an N-alkyl fluoroaliphaticsulfonamidoalkyl phosphate salt, said phosphate salt forming substantially no precipitate, (b) forming said slurry into paper and (c) drying said paper.

As used herein the term "paper" is used with reference to both paper and paperboard.

As used herein the term "hard water" refers to water containing at least about 85 ppm divalent salt, e.g., calcium and magnesium salts.

The method of the invention is particularly useful for providing paper and paperboard with resistance to wetting by liquids. The method of the invention can be used under hard water conditions without the addition of chelating agents or hydrocarbon surfactants. Generally, fluorochemical phosphate salts are provided as aqueous solutions containing substantial amounts of organic solvent, e.g., 20% or more and when added directly to hard water tend to precipitate and cause problems in production. Precipitation can be prevented by adding chelating agent to the water prior to the addition of the fluorochemical phosphate salt, but occasionally the chelating agent is inadvertently omitted or added after addition of the fluorochemical phosphate salt and precipitation occurs. Surprisingly, in the method of the present invention the fluorochemical phosphate salt can be added directly to hard water without the use of chelating agent and does not precipitate to any appreciable extent.

The N-alkyl fluoroaliphaticsulfonamidoalkyl phosphate salts useful in the present invention can be represented by the formula $$[R_fSO_2N(R)R'O]_mP(\overset{\overset{\displaystyle O}{\|}}{O}X)_{3-m}$$

wherein R is hydrogen or an alkyl group having from 1 to about 12, preferably from 1 to 6, carbon atoms; R' is an alkylene bridging group containing 2 to about 12 carbon atoms, preferably from 2 to 4 carbon atoms, and can be can be branched or straight chain; $R_f$ is a perfluoroaliphatic radical; m is integer from 1 to 3; and X is a monovalent salt forming ion.

The fluoroaliphatic group is designated herein as $R_f$. $R_f$ is a stable, inert, nonpolar, preferably saturated monovalent moiety which is both oleophobic and hydrophobic. $R_f$ preferably contains at least about 3 carbon atoms, more preferably 3 to about 20 carbon atoms, and most preferably about 6 to about 12 carbon atoms. $R_f$ can contain straight chain, branched chain, or cyclic fluorinated alkyl groups or combinations thereof or combinations thereof with straight chain, branched chain, or cyclic alkyl groups. $R_f$ is preferably free of polymerizable olefinic unsaturation and can optionally contain catenary heteroatoms such as oxygen, divalent or hexavalent sulfur, or nitrogen. It is preferred that each $R_f$ contain about 40% to about 78% fluorine by weight, more preferably about 50% to about 78% fluorine by weight The terminal portion of the $R_f$ group contains a fully fluorinated terminal group. This terminal group preferably contains at least 7 fluorine atoms, e.g., $CF_3CF_2CF_2$—, $(CF_3)_2CF$—, —$CF_2SF_5$, or the like. Perfluorinated aliphatic groups, i.e., those of the formula $C_nF_{2n+1}$, are the most preferred embodiments of $R_f$.

Generally, the fluorochemical phosphate salt is a mixture of monoester, diester and triester. The amount of triester present should not exceed about 5 weight percent of the product since it is not easily dispersed and contributes little to repellency. Typically, the ester distribution is about 5 to 10 weight percent monoester, about 75 to 90 weight percent diester and about 2 to 5 weight percent triester.

These phosphate salts include, for example: ammonium bis-(N-ethyl perfluorooctanesulfonamidoethyl) phosphate, sodium bis-(N-ethyl perfluorooctanesulfonamidoethyl) phosphate, lithium bis-(N-ethyl perfluorooctanesulfonamidoethyl) phosphate, diethanol ammonium bis-(N-ethyl perfluorooctanesulfonamidoethyl) phosphate, sodium mono-(N-hexyperfluorodecanesulfonamidoethyl) phosphate, ammonium bis-(N-propylperfluorocyclohexanesulfonamidoethyl) phosphate, lithium mono-(perfluorohexanesulfonamidobutyl) phosphate, ammonium bis-(N-ethyl perfluoroethylcyclohexanesulfonamidoethyl) phosphate, ammonium di-phenyl (N-hexylperfluorocyclohexanesulfonamidoethyl) phosphate, etc. Such compounds are disclosed, for example, in U.S. Pat. No. 3,094,547 (Heine) which is incorporated herein by reference.

These N-alkyl fluoroaliphaticsulfonamidoalkyl phosphate salts can be prepared according to the following reaction schemes:

Scheme I $$POCl_3 + mR_fSO_2N(R)R'OH \xrightarrow{\text{solvent}} [R_fSO_2N(R)R'O]_m\overset{O}{\overset{\|}{P}}Cl_{3-m}$$

$$[R_fSO_2N(R)R'O]_m\overset{O}{\overset{\|}{P}}Cl_{3-m} \xrightarrow{H_2O} [R_fSO_2N(R)R'O]_m\overset{O}{\overset{\|}{P}}(OH)_{3-m}$$

$$[R_fSO_2N(R)R'O]_m\overset{O}{\overset{\|}{P}}(OH)_{3-m} \xrightarrow{NH_4OH} [R_fSO_2N(R)R'O]_m\overset{O}{\overset{\|}{P}}(ONH_4)_{3-m}$$

Scheme II $$POCl_3 + (3-m)H_2O \longrightarrow (HO)_{3-m}\overset{O}{\overset{\|}{P}}Cl_m$$

$$(HO)_{3-m}\overset{O}{\overset{\|}{P}}Cl_m + mR_fSO_2N(R)R'OH \xrightarrow{\text{solvent}} [R_fSO_2N(R)R'O]_m\overset{O}{\overset{\|}{P}}(OH)_{3-m}$$

-continued $$[R_fSO_2N(R)R'O]_m\overset{O}{\overset{\|}{P}}(OH)_{3-m} \xrightarrow{NH_4OH} [R_fSO_2N(R)R'O]_m\overset{O}{\overset{\|}{P}}(ONH_4)_{3-m}$$

After formation of the fluorochemical phosphate acid, $$[R_fSO_2N(R)R'O]_m\overset{O}{\overset{\|}{P}}(OH)_{3-m},$$

the solvent can be stripped from the reaction product and an aqueous solution of the base, e.g., $NH_4OH$, is added to the molten reaction product to form the salt. Alternatively, a water miscible solvent, e.g., isopropyl alcohol, can be added after the reaction solvent, e.g., toluene, is stripped to control viscosity. Then, the aqueous solution of base is added and the isopropyl alcohol is stripped. Suitable bases for neutralization of the fluorochemical phosphate acid include, for example, ammonium hydroxide, sodium hydroxide, lithium hydroxide, sodium carbonate, sodium bicarbonate and diethanol amine.

Although the composition useful in the present invention is substantially solvent free, small amounts of organic solvent may be present in the final product, but such amounts must be sufficiently low so that precipitation of the product does not occur in hard water. Generally, isopropanol is preferably present in an amount of less than about 8 weight percent; butyl alcohol is preferably present in an amount of less than about 5 weight percent; ethyl carbitol is preferably present in an amount of less than about 10 weight percent; 2-butoxy ethanol is preferably present in an amount of less than about 5 weight percent; propyl propasol is preferably present in an amount of less than about 10 weight percent and butyl propylsolve is preferably present in an amount of less than about 5 weight percent.

The fluorochemical phosphate salt can be applied to paper either by internal addition in which the composition is dispersed in a pulp suspension or slurry for making paper or by external addition by dipping or spraying an aqueous solution of the composition onto paper or by use of a size press, all of which are well known to those skilled in the art. Preferably, the fluorochemical phosphate salt is applied to the paper in an amount of about 0.05 to 1, more preferably 0.1 to 0.5 weight percent, based on the weight of the paper.

The following non-limiting examples are provided to further illustrate the invention. In the examples all parts and percentages are by weight unless otherwise indicated. In the performance evaluations in the examples, all tests were carried out on 36.5 lb/3000 sq ft solid bleached sulfate water leaf paper by size press application. Where precipitation is observed, "slight" indicates about 5 to 10% precipitation, "moderate" indicates about 20 to 40% precipitation and "heavy" indicates about 50 to 100% precipitation. The following test (Kit Test) was used to evaluate the repellency of paper to grease, oil and waxes:

Reagents are prepared as follows:

| Kit Number | Volume Castor Oil, $cm^3$ | Volume Toluene, $cm^3$ | Volume Heptane, $cm^3$ |
|---|---|---|---|
| 1 | 200 | 0 | 0 |
| 2 | 180 | 10 | 10 |
| 3 | 160 | 20 | 20 |
| 4 | 140 | 30 | 30 |
| 5 | 120 | 40 | 40 |
| 6 | 100 | 50 | 50 |
| 7 | 80 | 60 | 60 |
| 8 | 60 | 70 | 70 |
| 9 | 40 | 80 | 80 |
| 10 | 20 | 90 | 90 |
| 11 | 0 | 100 | 100 |
| 12 | 0 | 90 | 110 |

A paper test specimen is placed on a clean, flat surface and a drop of test solution is released from a height of 25 mm (1 in). after 15 seconds, excess fluid is removed with a clean tissue or cotton swatch and the wetted area is examined. A failure is denoted by a pronounced darkening of the test specimen. The Kit Rating is the highest numbered solution that stands on the test surface for 15 seconds without causing failure.

The Ralston Crease Test is used to determine the amount of oil penetration through a sample of paper. The sample is conditioned for at least 24 hours at 22.8±0.8° C. and 50±2% relative humidity. A 10 cm×10 cm conditioned sample is placed on a smooth glass plate and folded through the center parallel to an edge to provide a preliminary light crease. A creasing roller weighing 2040±45 g and being 9.5 cm in diameter and 4.5 cm wide with a rubber cover approximately 0.6 cm thick and having a Shore A Durometer hardness of 75±5 is rolled once over the crease without additional pressure. The paper is unfolded and the crease line is again rolled. The paper is folded at 90° to the first fold with the side on the outside for the first fold now on the inside, rolled, unfolded and again rolled.

The sample is placed on a grid sheet having squares 1 cm×1 cm which is on an unprinted sheet which is on a backup plate. A metal ring, 7.5 cm diameter, 1.25 cm high, wall thickness of 15.9 mm, is placed on the sample. A 2.5 cm high tube having a 2.5 cm inside diameter is placed in the center of the ring and 5 g of sand are poured into the tube and the tube is then removed. 100 g of synthetic oil is dyed by mixing with 0.1 g red dye. 1.3 cc of the red dyed synthetic oil is delivered to the sand pile. The samples with oiled sand are place in an oven at 60±1.1° C. for 24±0.25 hr, removed from the oven and examined for stains. Each square on the grid represents 1%. The Crease Rating is the number of squares which are stained. All equipment and materials for this Crease Test are available from Ralston Purina Company.

Intermediate A

A clean, dry 250 mL three-necked flask fitted with a condenser, a Dean Stark trap filled with toluene, a stirrer, a thermometer, and a means for controlling temperature was charged with 23 g phosphorous oxychloride ($POCl_3$) (0.15 moles) and cooled to 15° C. After reaching 15° C., 2.65 g water (0.147 moles) was added which resulted in an immediate exotherm to 59° C. Then, 30 g of toluene, 167.9 g of N-ethyl perfluorooctanesulfonamidoethyl alcohol with 5 g additional toluene were added. The solution temperature was raised to reflux. Reflux began at about 105° C. and was continued for 4 hours at about 115° C. The resulting solution was transferred to a 250 mL jar and allowed to cool to room temperature.

Intermediate B

A clean, dry 250 mL three-necked flask fitted with a condenser, a nitrogen inlet, a stirrer, a thermometer, and a means for controlling temperature was charged with 23 g phosphorous oxychloride ($POCl_3$) (0.15 moles) and 8 g of toluene and cooled to 15° C. After reaching 15° C., 2.65 g Water (0.147 moles) was rapidly added via a 3 mL syringe. This resulted in an immediate exotherm to 59° C. The batch was held at 60° C. for 1 hour. Then, 37 g of toluene, 167.9 g of N-ethyl perfluorooctanesulfonamidoethyl alcohol were added to the flask. The mixture temperature was raised to reflux (about 115° C.). Reflux was continued for about 6 hours under a nitrogen purge. The batch was then cooled to about 90° C. and 1 g of deionized water was added to hydrolyze any residual $POCl_3$. The toluene and residual water were removed using vacuum at 90° C. for about 30 minutes. The batch was then cooled to about 75° C. and 44 g of isopropyl alcohol (IPA) was added to yield an 80% solids solution.

Intermediate C

A clean, dry 1000 mL three-necked flask fitted with a condenser, stirrer, and an addition port was charged with 38.35 g (0.25 mole) $POCl_3$ and 50 g toluene. 4.41 g (0.245 mole) of deionized water was added via a syringe over 30 seconds. The reaction exothermed to 40° C. The hydrochloric acid (HCl) generated was directed through a sodium hydroxide (NaOH) scrubber solution on the output of the condenser. A heat mantle was placed under the flask and the reaction was continued for 1 hour at about 60° C. The solution was allowed to stand overnight (about 15 hrs) with a DRIRITE trap placed on the exit of the condenser. The next day, 232.26 g (0.49 mole) of premelted ZONYL TM BA, $C_nF_{2n+1}CH_2CH_2OH$, n=6–12, available from DuPont, was added via an addition funnel followed by a toluene rinse of the funnel. The mixture was allowed to react for 5 hours at reflux. An additional 1 mL of deionized water was added to hydrolyze any residual $POCl_3$. The toluene and water were stripped at 90° C. using vacuum. The vacuum was held for about 30 minutes during which time about 50 g toluene with a small amount of water were collected. 50 g of IPA were added to provide a solids content of about 80–82%.

EXAMPLE 1

Fluorochemical Phosphate Salt I (FCPS I) was prepared as follows: A clean, dry 500 mL three-necked flask was fitted with a Dean-Stark trap, a stirrer, a thermometer, and a means for controlling temperature. The jar containing Intermediate A as prepared above was placed in an oven at about 100° C. to melt the material to facilitate transfer and 79.3 g of Intermediate A was added to the flask. This was heated to about 100° C. where vacuum stripping of the toluene was begun. Temperature was increased during stripping to about 120° C. The stripping was completed in about 35 minutes. 14.9 g of condensate was collected in the Dean Stark trap. The temperature of the solution was lowered to about 78° C. A two-phase system resulted when 150 g of deionized water was slowly added to the remaining 64.4 g of stripped Intermediate A. An additional 160 g of deionized water was added. The two-phase mixture was held at about 80° C. while 3.0 g of ammonium hydroxide was added. The two phases begin to disperse in one another. An additional 3.1 g ammonium hydroxide was added. An additional 23.7 g deionized water was added, the heat removed, and the solution was allowed to cool to room temperature with agitation. The resulting solution had a pH of 10 and a solids content of 16.4%.

A treating bath was prepared diluting FCPS I in 50 grams of hard water (approx. 250 ppm divalent salt). The amount of FCPS I added to the hard water was calculated to deposit 0.2% of the fluorochemical solids on the 36.5 lb/3000 sq ft solid bleached sulfate water leaf paper by size press application. The wet pickup at the size press was determined to be 93.6%.

The resulting diluted mixture was then immediately observed for precipitation of solids. No precipitation had occurred. The treating solution was placed in a size press treating bath and a sample of paper was saturated by being drawn through the bath. The saturated substrate was then padded with a set of rubber rollers set at 137.8 kN/m$^2$ at a rate of 0.45 m/min. The treated paper was dried on a 3M model 9014 Imaging System Dryer set at about 138° C. for 10 seconds. The dried treated paper was conditioned overnight (about 15 hours) at 22° C. and 50% relative humidity. The conditioned samples were then tested for oil resistance using the Kit Test. The Kit Rating was 7.

EXAMPLE 2

Fluorochemical Phosphate Salt II (FCPS II) was prepared as follows: A clean, dry 500 mL three-necked flask was fitted with a condenser and Dean-Stark trap, a stirrer, a thermometer, and a means for controlling temperature. The jar containing Intermediate B as prepared above was placed in an oven at about 70° C. to melt the contents. Then, 100 parts of Intermediate B were added to the flask and diluted to 15% by the addition of a first charge of 250 parts deionized water added slowly to minimize foaming with the temperature of the mixture maintained at about 65° C. to 70° C. The resulting product was a gummy semisolid material. A second charge of 203 parts deionized water and 8.1 parts ammonium hydroxide was added and the neutralization reaction was allowed to progress for about 2 hours. The alcohol was then stripped from the product at a temperature of about 60° C. to 75° C. using a nitrogen purge. The resulting product contained 15% fluorochemical phosphate salt solids and 0.9% residual isopropyl alcohol.

A treating solution was prepared as in Example 1. No precipitation occurred. Paper was treated, dried and conditioned as in Example 1 and tested for Kit Rating. The Kit Rating was 7+.

EXAMPLES 3-7

Fluorochemical Phosphate Salts III-VII (FCPS III--VII) were prepared. For FCPS III, a clean, dry 500 mL three-necked flask was fitted with a condenser and Dean-Stark trap, a stirrer, a thermometer, and a means for controlling temperature. The jar containing Intermediate B as prepared above was placed in an oven at about 70° C. to melt the contents. Then 100 g of Intermediate B was added to the flask. The isopropyl alcohol was stripped at a temperature of 60° C. to 75° C. using vacuum. The vacuum was adjusted to control foaming. From this stripping 18.5 g of isopropyl alcohol was collected. The resulting 81.5 g of solids was diluted to 15% by the addition of a first charge of 250 g deionized water added slowly to minimize foaming with the temperature of the mixture maintained at about 65° C. to 70° C. The resulting product was a gummy semisolid material. A second charge of 203 g of deionized water and 8.1 g of ammonium hydroxide was added. As the addition progressed, the gummy solids turned to a viscous opaque solution within about 30 minutes which was easily stirred. With completed addition, the viscosity increased and the pH increased to about 9-10.

FCPS IV-VII were prepared in a similar manner. For FCPS IV, the second charge of deionized water contained 243 g water, 6.7 g diethanol amine and no ammonium hydroxide. This neutralization was allowed to progress for about 2 hours at about 65° C. resulting in a somewhat opaque solution having a pH of about 9. For FCPS V, the second charge contained 229 g deionized water, 2.6 g sodium hydroxide and no ammonium hydroxide. The pH was adjusted to 9-10 with sodium hydroxide pellets. For FCPS VI, the second charge contained 229 g deionized water, 2.7 g lithium hydroxide monohydrate and no ammonium hydroxide. The pH was adjusted with 0.27 g lithium hydroxide monohydrate.

A treating solution was prepared using each of FCPS III-VII and paper was treated, dried and conditioned as described in Example 1. Each sample was observed for precipitation and tested for Kit Rating and Crease Rating. The results are set forth in Table 1.

TABLE 1

| Example | FCPS | Precipitation | Kit Rating | Crease Rating |
|---|---|---|---|---|
| 3 | III | none | 8+ | 5.5 |
| 4 | IV | none | 8+ | 12.5 |
| 5 | V | none | 9+ | 4.4 |
| 6 | VI | none | 9+ | 0.1 |

As can be seen from the data in Table 1, each of the treating solutions provided good Kit Ratings and Crease Ratings with no precipitation of the FCPS.

COMPARATIVE EXAMPLES C1-C6

To prepare fluorochemical phosphate salt VIII (FCPS VIII), 50 g pre-melted Intermediate C was added to a 500 mL three-necked flask fitted with a stirrer, thermometer, a means for controlling temperature, and a Dean Stark trap with a condenser. To this was added a mixture of 221.6 g deionized water and 5.1 ammonium hydroxide dropwise over 30 minutes while heating to 65° C. The reaction was continued for 1 hour at about 65° C. The isopropyl alcohol was stripped over a temperature range of 60 to 75° C. using vacuum. Sufficient deionized water was added to result in 15% solids. Fluorochemical phosphate salts IX and X (FCPS IX and X) Were prepared in the same manner as FCPS VIII except for FCPS IX 1.67 g lithium hydroxide monohydrate and for FCPS X 4.2 g diethanol amine were added instead of the ammonium hydroxide.

Treating solutions were prepared as in Example 1 and samples of paper were treated, dried and conditioned as in Example 1. Treating solutions were also prepared using deionized (DI) water instead of the hard water and samples of paper were treated, dried and conditioned in the same manner as the hard water samples. Each solution was observed for precipitation and the paper was tested for Kit Rating. The results are set forth in Table 2.

TABLE 2

| Example | FCPS | Water | Precipitation | Kit Rating |
|---|---|---|---|---|
| C1 | VIII | DI | none | 5 |
| C2 | VIII | hard | heavy | 0 |
| C3 | IX | DI | none | 6 |
| C4 | IX | hard | heavy | 0 |
| C5 | X | DI | none | 6 |
| C6 | X | hard | heavy | 0 |

As can be seen from the data in Table 2, fluoroalkanealkyl phosphate salts, $(R_fCH_2CH_2)_mP(O)(OX)_{3-m}$, m=1, 2 or 3, provide good Kit Ratings with no precipitation when used in deionized water, but provide no oil repellency and precipitate heavily in hard water.

EXAMPLES 7 AND 8 AND COMPARATIVE EXAMPLES C7–C12

For Examples C7–C12, anionic surfactants were added to fluorochemical phosphate salts as set forth in Table 3 to provide 5 weight percent surfactant solids in each example.

TABLE 3

| Example | FCPS | FCPS wt % | Surfactant | Surfactant wt % |
|---|---|---|---|---|
| C7 | III | 95 | SIPONATE TM DS-10 | 5 |
| C8 | III | 83.3 | SIPEX TM EST | 16.7 |
| C9 | III | 85.7 | SERMUL TM EA-146 | 14.3 |
| C10 | IV | 95 | SIPONATE TM DS-10 | 5 |
| C11 | IV | 83.3 | SIPEX TM EST | 16.7 |
| C12 | IV | 85.7 | SERMUL TM EA-146 | 14.3 |

These compositions were used to prepare treating baths as in Example 1. For Examples 7 and 8, treating baths were prepared as in Example 1 using FCPS III and FCPS IV, respectively, without the addition of surfactant. Samples of paper were treated, dried and conditioned as in Example 1. The treating baths were observed for precipitation. The treated samples of paper were tested for Kit Rating and Crease Rating. The results are set forth in Table 4.

TABLE 4

| Example | Precipitation | Kit Rating | Crease Rating |
|---|---|---|---|
| 7 | slight | 8+ | 5.5 |
| C7 | none | 6+ | 100 |
| C8 | none | 7 | 100 |
| C9 | none | 7 | 24 |
| 8 | none | 8+ | 3.4 |
| C10 | none | 6 | 100 |
| C11 | none | 7 | 100 |
| C12 | none | 7 | 42.8 |

As can be seen from the data in Table 4, addition of anionic surfactant to the fluorochemical phosphate salt may slightly reduce precipitation, but the Kit Rating is somewhat reduced and oil resistance as measured by the Crease Test is significantly reduced.

Various modifications and alterations of this invention will be apparent to those skilled in the art without departing from the scope and spirit of this invention and this invention should not be restricted to that set forth herein for illustrative purposes.

What is claimed is:

1. A method for sizing paper to improve resistance to wetting by liquids under hard water conditions comprising (a) contacting paper sheet material with a hydrocarbon surfactant free, substantially organic solvent free aqueous solution of hard water and an N-alkyl fluoroaliphaticsulfonamidoalkyl phosphate salt represented by the formula $$[R_fSO_2N(R)R'O]_mP(\overset{\overset{\displaystyle O}{\|}}{O})(OX)_{3-m}$$

wherein R is hydrogen or an alkyl group having from 1 to about 12, preferably from 1 to 6, carbon atoms; R' is an alkylene bridging group containing 2 to about 12 carbon atoms, preferably from 2 to 4 carbon atoms, and can be can be branched or straight chain; $R_f$ is a perfluoroaliphatic radical; m is integer from 1 to 3; and X is a monovalent salt forming ion, said phosphate salt comprises about 5 to 10 percent m=1, 75 to 90 weight percent m=2 and 2 to 5 weight percent m=3 and (b) drying said sheet material.

2. The method of claim 1 wherein said phosphate salt is present in an amount of about 0.05 to 1.0 weight percent.

3. The method of claim 1 wherein said phosphate salt is present in an amount of about 0.1 to 0.5 weight percent.

4. The method of claim 1 wherein said phosphate salt is the ammonium, sodium, lithium or diethyl ammonium salt of N-ethyl perfluorooctanesulfonamidoethyl) phosphate.

5. The method of claim 1 wherein said phosphate salt is the ammonium, sodium, lithium or diethyl ammonium salt of N-methyl perfluorooctanesulfonamidoethyl) phosphate.

6. A method for sizing paper to improve resistance to wetting by liquids comprising (a) adding to a paper pulp slurry a hydrocarbon surfactant free, substantially organic solvent free aqueous solution of hard water and an N-alkyl fluoroaliphaticsulfonamidoalkyl phosphate salt, represented by the formula

| Kit Number | Volume Castor Oil, $cm^3$ | Volume Toluene, $cm^3$ | Volume Heptane, $cm^3$ |
|---|---|---|---|
| 1 | 200 | 0 | 0 |
| 2 | 180 | 10 | 10 |
| 3 | 160 | 20 | 20 |
| 4 | 140 | 30 | 30 |
| 5 | 120 | 40 | 40 |
| 6 | 100 | 50 | 50 |
| 7 | 80 | 60 | 60 |
| 8 | 60 | 70 | 70 |
| 9 | 40 | 80 | 80 |
| 10 | 20 | 90 | 90 |
| 11 | 0 | 100 | 100 |
| 12 | 0 | 90 | 110 |

wherein R is hydrogen or an alkyl group having from 1 to about 12, preferably from 1 to 6, carbon atoms; R' is an alkylene bridging group containing 2 to about 12 carbon atoms, preferably from 2 to 4 carbon atoms, and can be can be branched or straight chain; $R_f$ is a perfluoroaliphatic radical; m is integer from 1 to 3; and X is a monovalent salt forming ion, said phosphate salt comprises about 5 to 10 weight percent m=1, 75 to 90 weight percent m=2 and 2 to 5 weight percent m=3, (b) forming said slurry into paper and (c) drying said paper.

7. The method of claim 6 wherein said phosphate salt is present in an amount of about 0.05 to 1.0 weight percent.

8. The method of claim 6 wherein said phosphate salt is present in an amount of about 0.1 to 0.5 weight percent.

9. The method of claim 6 wherein said phosphate salt is the ammonium, sodium, lithium or diethyl ammonium, salt of N-ethyl perfluorooctanesulfonamidoethyl) phosphate.

10. The method of claim 8 wherein said phosphate salt is the ammonium, sodium, lithium or diethyl ammonium salt of N-methyl perfluorooctanesulfonamidoethyl) phosphate.

* * * * *

UNITED STATES PATENT AND TRADEMARK OFFICE

CERTIFICATE OF CORRECTION

PATENT NO. : 5,271,806

DATED : December 21, 1993

INVENTOR(S) : Robert F. Deutsch, John W. Eberlin and Robert F. Kamrath

It is certified that error appears in the above-indentified patent and that said Letters Patent is hereby corrected as shown below:

Col. 10, lines 44-58 delete entire table and insert in it's place:

-- $[R_fSO_2N(R)R'O]_mP(OX)_{3-m}$ --

Signed and Sealed this

Twenty-fourth Day of May, 1994

*Attest:*

BRUCE LEHMAN

*Attesting Officer*

*Commissioner of Patents and Trademarks*